US007699082B2

(12) United States Patent
Peng

(10) Patent No.: US 7,699,082 B2
(45) Date of Patent: Apr. 20, 2010

(54) ELECTRIC MULTI-PENCIL SHARPENER

(75) Inventor: Yuhua Andy Peng, Shenzhen (CN)

(73) Assignee: Yurisheng Electronic (Shenzhen) Co., Ltd, Shenzhen (CN)

( * ) Notice: Subject to any disclaimer, the term of this patent is extended or adjusted under 35 U.S.C. 154(b) by 651 days.

(21) Appl. No.: 11/611,899

(22) Filed: Dec. 18, 2006

(65) Prior Publication Data

US 2008/0142117 A1 Jun. 19, 2008

(51) Int. Cl.
*B43L 23/02* (2006.01)

(52) U.S. Cl. ..... 144/28.4; 144/28.7; 144/28.72

(58) Field of Classification Search ..... 144/28.1–28.9
See application file for complete search history.

(56) References Cited

U.S. PATENT DOCUMENTS 3,712,351 A * 1/1973 Kuramochi ..... 144/28.72
3,860,049 A * 1/1975 Kuramochi ..... 144/28.72

* cited by examiner

*Primary Examiner*—Shelley Self

(57) ABSTRACT

An electric multi-pencil sharpener includes an entering pencil vase, a sending mechanism, a hustling mechanism, a sharpening mechanism, and an exit pencil vase. The entering pencil vase includes a pushing mechanism for pushing pencils. The hustling mechanism is for clamping pencils to take the pencils into or out of the sharpening mechanism. The sharpening mechanism is for sharpening the pencils. The exit pencil vase has an exit mechanism. The sending mechanism connects the pushing mechanism, the hustling mechanism, and the exit mechanism, to move the pencils from the pushing mechanism to the hustling mechanism and move the pencils sharpened by the sharpening mechanism to the exit mechanism.

10 Claims, 10 Drawing Sheets

ELECTRIC MULTI-PENCIL SHARPENER

BACKGROUND OF THE INVENTION

The present invention relates to electronic pencil sharpeners, and particularly to an electric multi-pencil sharpener which can automatically and continuously sharpen pencils.

Currently, a traditional electric pencil sharpener includes a motor, a transmission mechanism, and a sharpening mechanism. When a pencil is inserted into the electric pencil sharpener, the transmission mechanism driven by the motor drives the sharpening mechanism to work, and a cutter of the sharpening mechanism rotates to automatically sharpen the pencil. However, such pencil sharpener is incapable of sharpening pencils continuously. The pencils must be replaced one by one by operators, which is inefficient.

What is needed is to provide an electric multi-pencil sharpener that automatically continues to sharpen pencils.

BRIEF SUMMARY OF THE INVENTION

An exemplary electric multi-pencil sharpener includes an entering pencil vase, a sending mechanism, a hustling mechanism, a sharpening mechanism, and an exit pencil vase. The entering pencil vase includes a pushing mechanism for pushing pencils. The hustling mechanism is for clamping pencils to take the pencils into or out of the sharpening mechanism. The sharpening mechanism is for sharpening the pencils. The exit pencil vase has an exit mechanism. The sending mechanism connects the pushing mechanism, the hustling mechanism, and the exit mechanism, to move the pencils from the pushing mechanism to the hustling mechanism and move the pencils sharpened by the sharpening mechanism to the exit mechanism.

Other objects, advantages and novel features of the invention will become more apparent from the following detailed description when taken in conjunction with the accompanying drawings, in which:

DETAILED DESCRIPTION OF THE INVENTION

Figure 1:
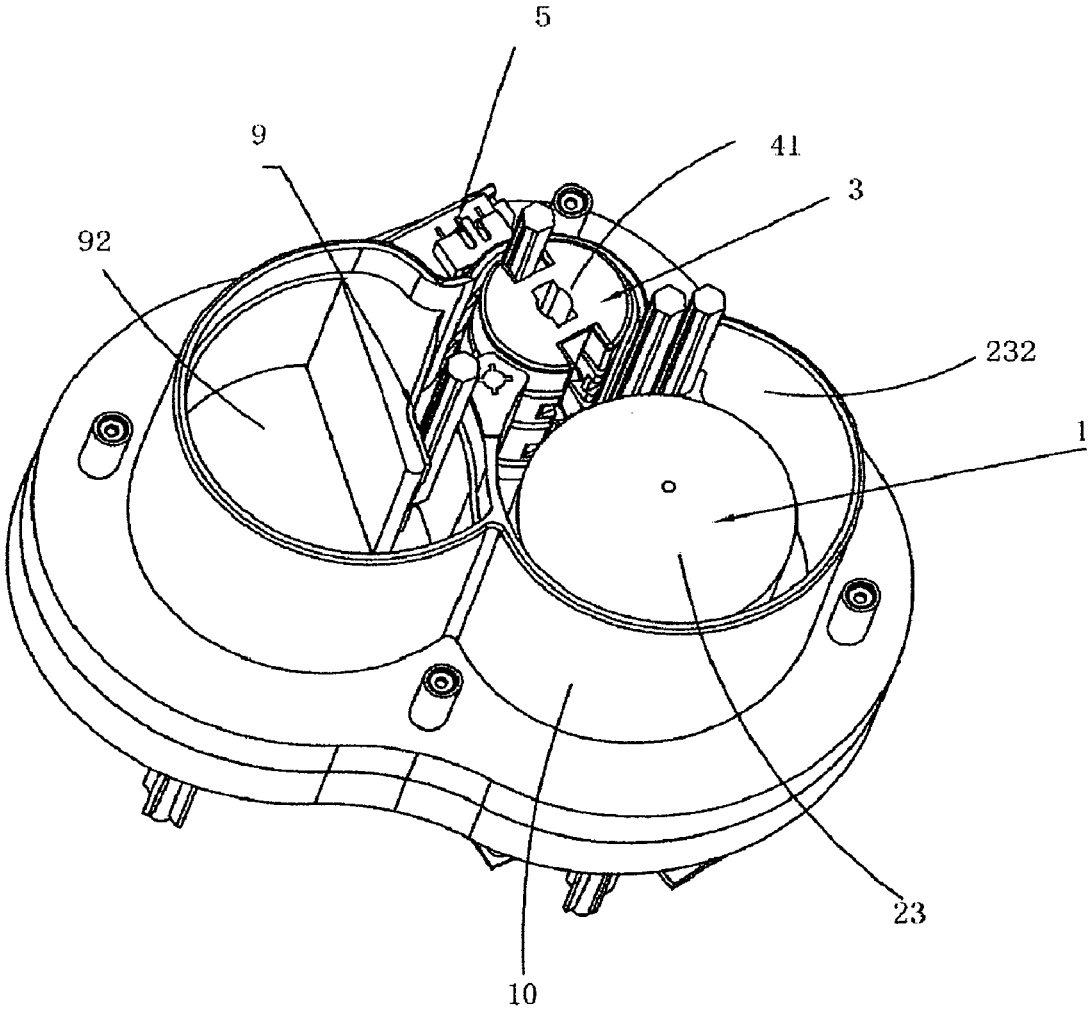
FIG. 1 is an isometric view of an electric multi-pencil sharpener in accordance with a preferred embodiment of the present invention, the electric multi-pencil sharpener includes a pushing mechanism, a sending mechanism, a hustling mechanism, a sharpening mechanism, an exit mechanism, a detecting mechanism, and a replaceable cutter subassembly.
Figure 2:
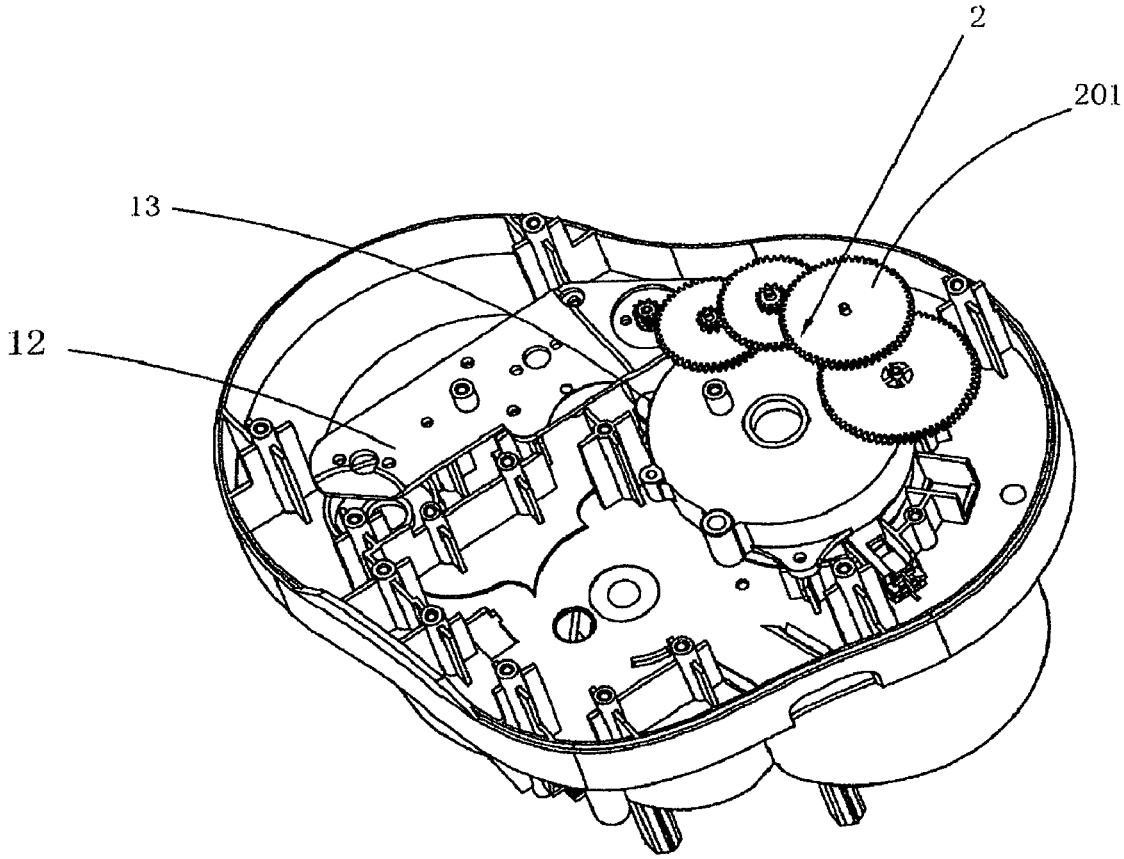
FIG. 2 is similar to FIG. 1, but an inverted view.
Figure 3:
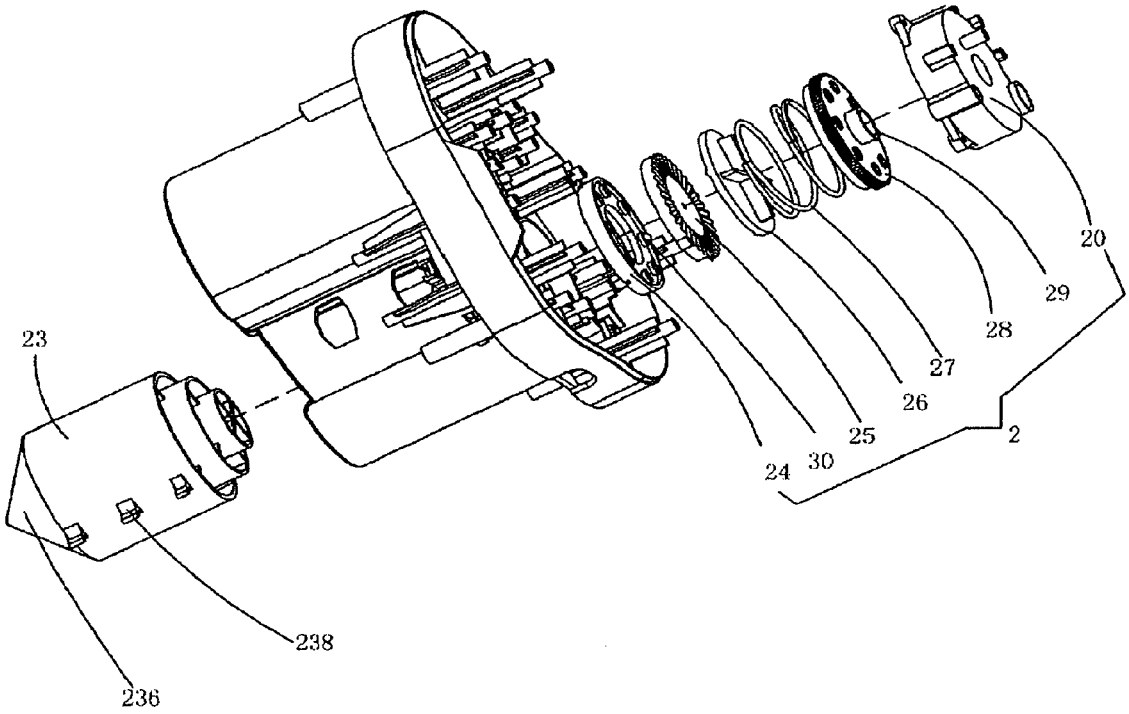
FIG. 3 is an exploded, and isometric view of the pushing mechanism of FIG. 1, but viewed from another aspect.
Figure 4:
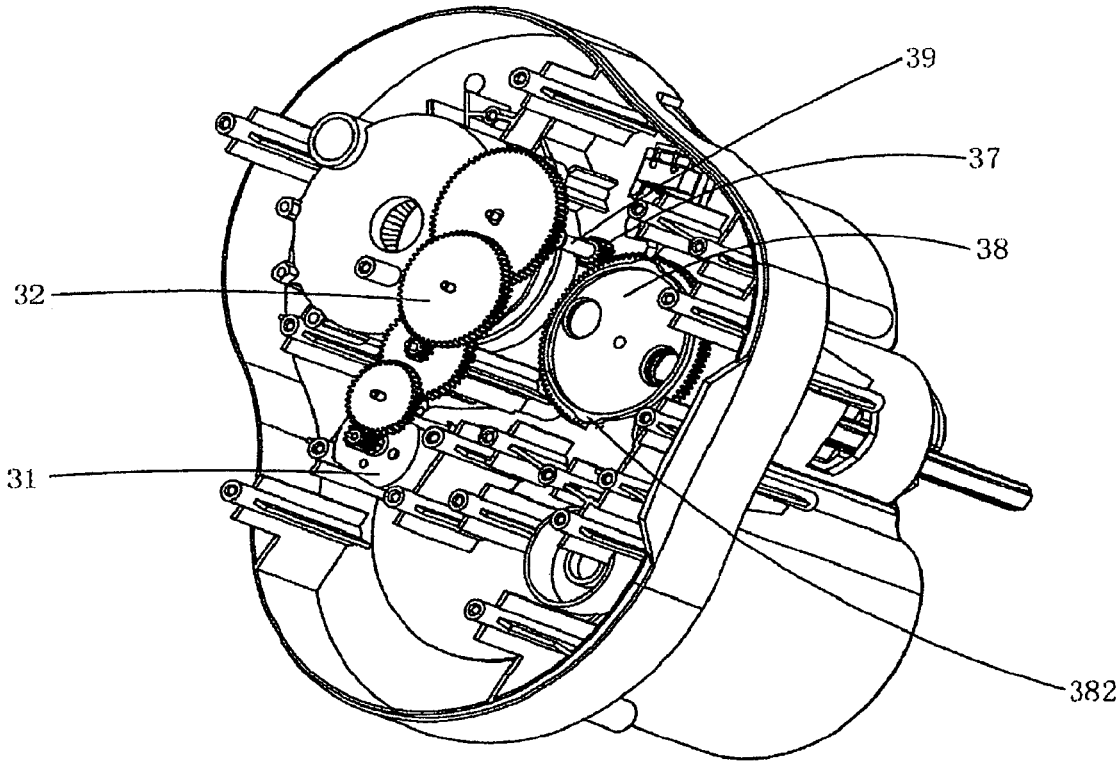
FIG. 4 is similar to FIG. 2, but viewed from another aspect.
Figure 5:
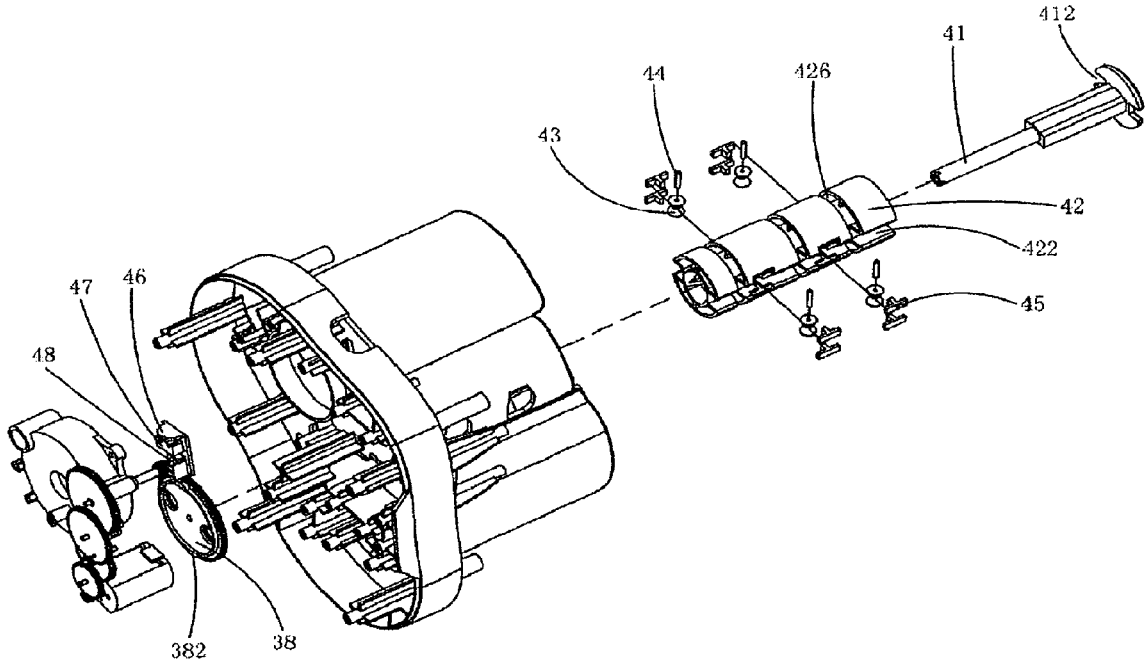
FIG. 5 is an exploded, and isometric view of the sending mechanism of FIG. 1, but viewed from another aspect.
Figure 6:
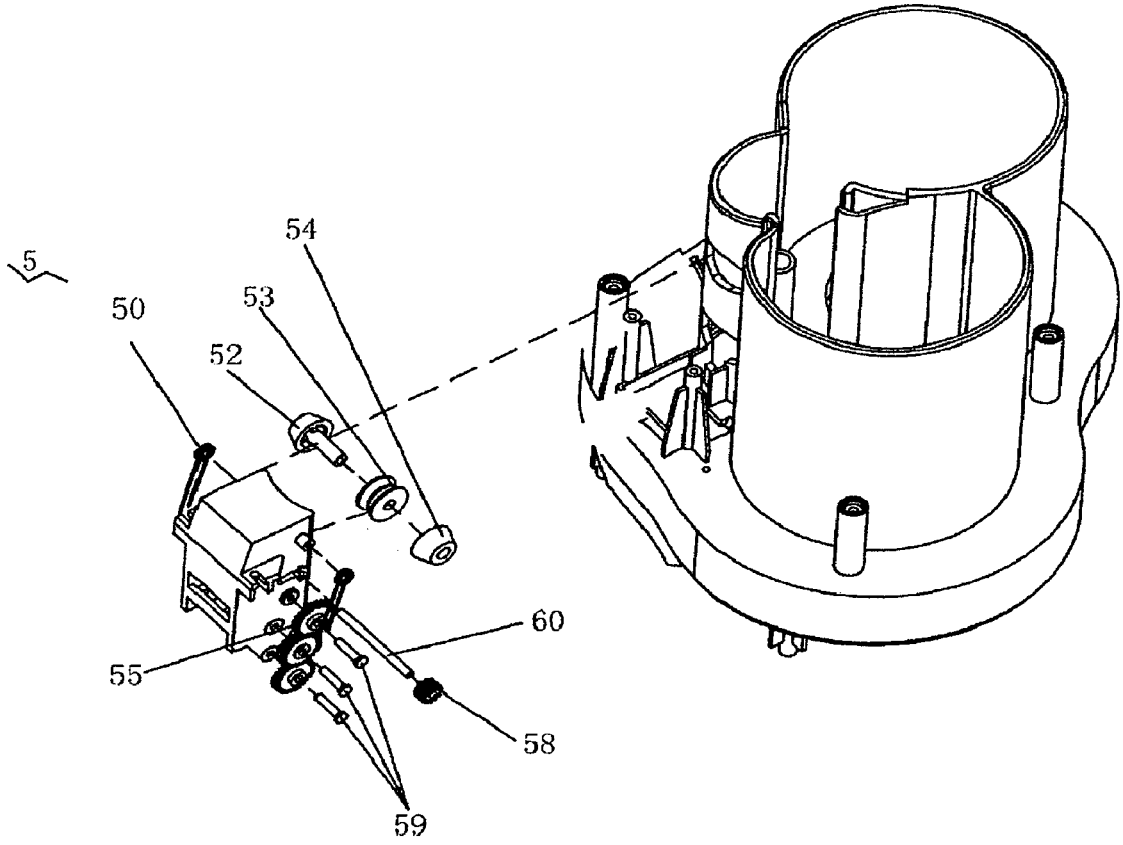
FIG. 6 is an exploded, and isometric view of the hustling mechanism of FIG. 1, but viewed from another aspect.
Figure 7:
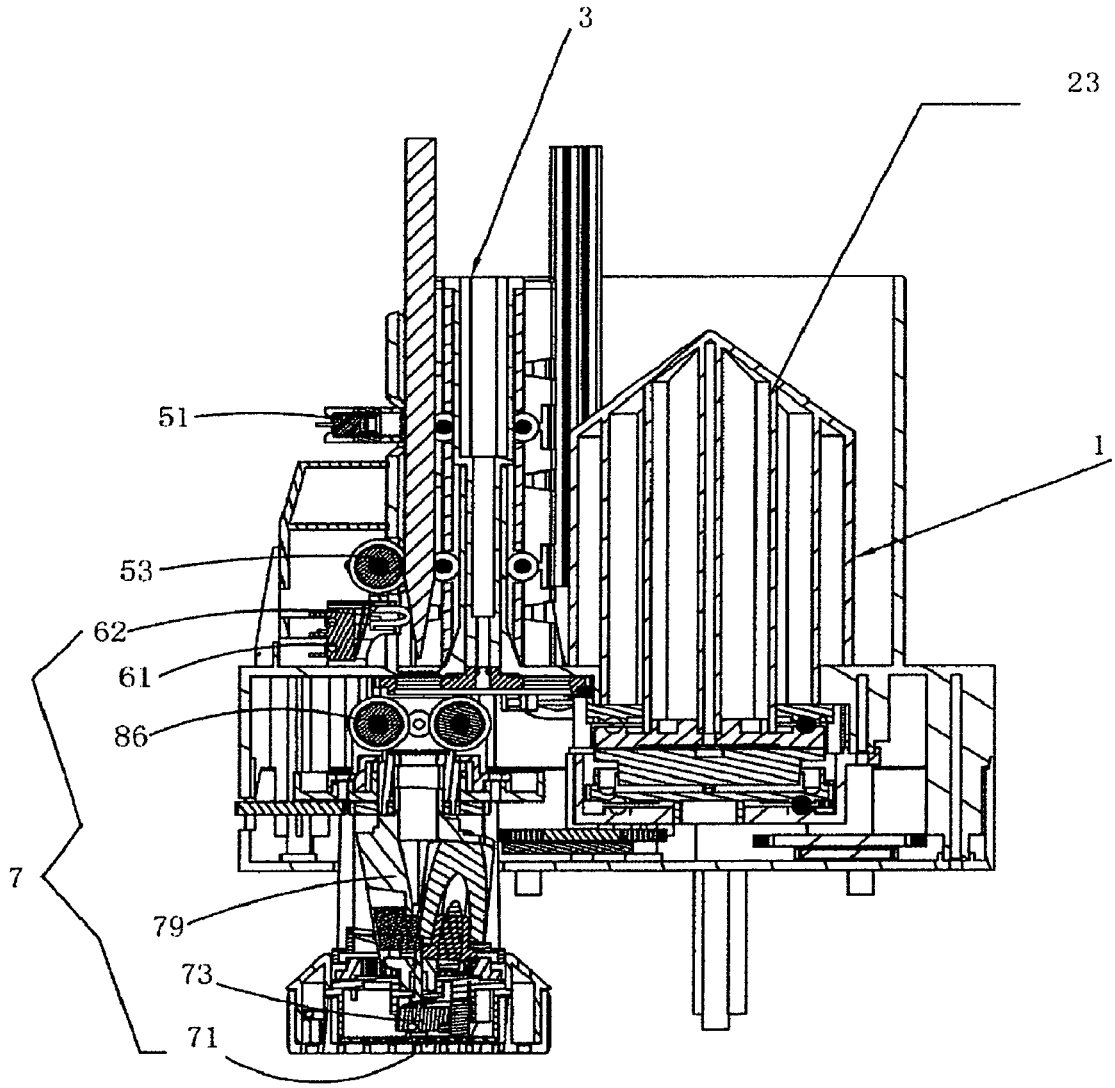
FIG. 7 is a cross-sectional view of the hustling mechanism and the sharpening mechanism of FIG. 1.
Figure 8:
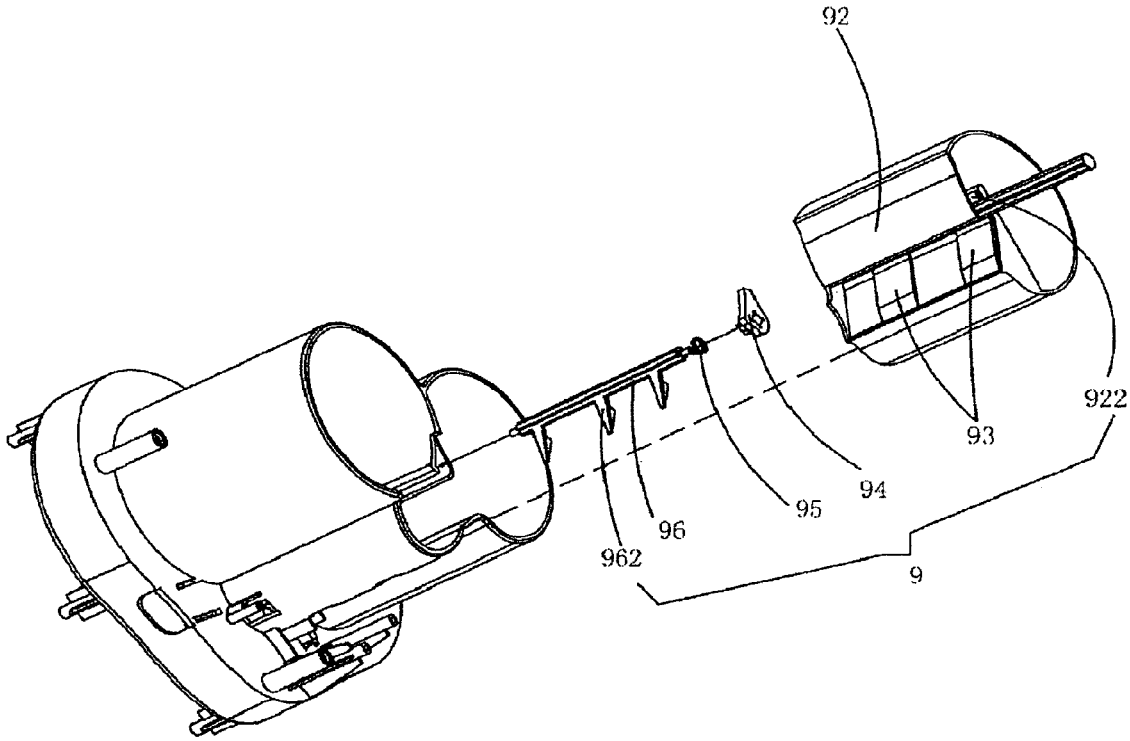
FIG. 8 is an exploded, isometric view of the exit mechanism of FIG. 1, but viewed from another aspect.
Figure 9:
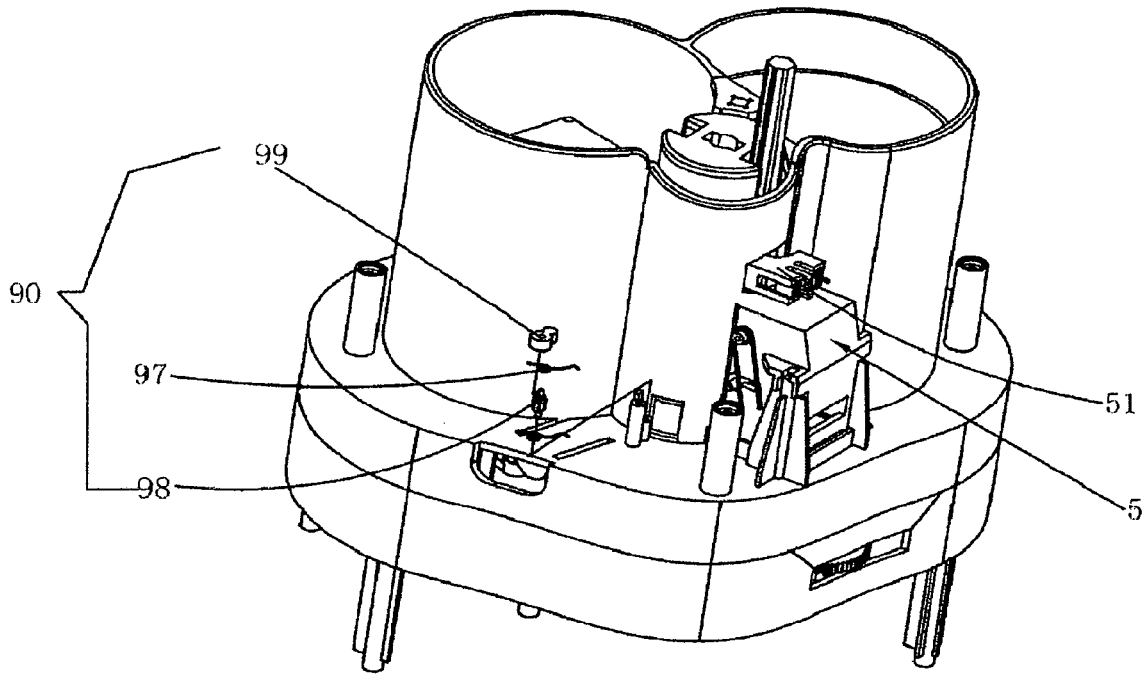
FIG. 9 is an exploded, and isometric view of the detecting mechanism of FIG. 1, but viewed from another aspect.

Referring to FIGS. 1 to 10, an electronic multi-pencil sharpener in accordance with a preferred embodiment of the present invention includes an entering pencil vase 10 having a pushing mechanism 1, a sending mechanism 3, a hustling mechanism 5, a sharpening mechanism 7, and an exit pencil vase 92 that is configured for receiving pencils. The exit pencil vase 92 has an exit mechanism 9 therein.

Referring to FIGS. 1 to 3 again, the pushing mechanism 1 includes a motor 13, a shaft 23, and a transmission subassembly 2 that transmits motivity generated by the motor 13 to the shaft 23. The motor 13 is mounted to a mounting board 12. The shaft 23 is mounted to a bearing board 24 and is placed in the entering pencil vase 10. An annular slot 232 is defined between the entering pencil vase 10 and the shaft 23. The shaft 23 has a cone-shaped surface 236 at an end thereof that is located at an open end of the entering pencil vase 10, for the pencils sliding into the annular slot 232. A plurality of pushing arms 238 extends out from a circumference of the shaft 23. The pushing arms 238 rotate together with the shaft 23, and push the pencils in the annular slots 232 tightly in order. The transmission subassembly 2 includes a reduction gear assembly 201, clutch boards 25 and 26, a compression spring 27, and a bearing gear 28. The clutch boards 25 and 26 are joggled each other by many wave-shaped teeth to achieve transmitting activity. A bearing cap 20 covers the bearing gear 28. A plurality of bearing balls 29 are mounted between the bearing gear 28 and the bearing cap 20. A plurality of bearing balls 30 are mounted between the bearing board 24 and the clutch board 25. The bearing balls 29, 30 are antifriction to reduce energy loss and improve movement flexible.

When pencils are put into the entering pencil vase 10, the pencils slide into the annular slot 232 along the cone-shaped surface 236 of the shaft 23 via action of gravity. The motor 13 starts to drive the reduction gear assembly 201 to rotate. The reduction gear assembly 201 drives the bearing gear 28 to rotate. Thus, the clutch board 26 rotates. The clutch board 25 rotates via an axial contractile force of the compression spring 27. The bearing board 24 and the shaft 23 rotate together with the clutch board 25. The pushing arms 238 push the pencils in the annular slots 232 tightly in order.

Referring to FIGS. 4 and 5 again, the sending mechanism 3 includes a motor 31, a reduction gear assembly 32, a first drive gear 37 connected to the reduction gear assembly 32, a second drive gear 38 which is a last stage drive gear, a first drive shaft 39 cooperating with the first drive gear 37, and a second drive shaft 41 cooperating with the second drive gear 38. The first drive gear 37 is connected to the reduction gear assembly 32 via the first drive shaft 39. The second drive shaft 41 is threadedly connected to the second drive gear 38. The sending mechanism 3 further includes a sending shaft 42, a plurality of rubber sending wheels 43, a plurality of wheel shafts 44, and a plurality of pressing members 45. The second drive shaft 41 passes through a center of the sending shaft 42. A plurality of quadrate receiving slots 412, 422 is defined in circumferences of the second drive shaft 41 and the sending shaft 42 respectively, for receiving the pencils. The number of the receiving slots 412, 422 is two, three, or more. A plurality of spaced annular guiding slots 426 are defined in the circumference of the sending shaft 42. The wheel shafts 44 pass through centers of the corresponding rubber sending wheels 43, and are mounted to the sending shaft 42 via the corresponding pressing members 45. The rubber sending wheels 43 are mounted in the corresponding receiving slots 422 of the sending shaft 42 via the corresponding wheel shafts 44 and the corresponding pressing members 45. The pencils slide in the corresponding receiving slots 412 of the second drive shaft 41 and the corresponding receiving slots 422 of the sending shaft 42 and along circumferences of the corresponding rubber sending wheels 43.

The motor 31 drives the reduction gear assembly 32 to rotate. The reduction gear assembly 32 drives the first drive gear 37 to rotate via the first drive shaft 39. The first drive gear 37 drives the second drive gear 38 to rotate. Because the second drive shaft 41 is threadedly connected to the second drive gear 38, the second drive gear 38 drives the second drive shaft 41 to rotate, and the second drive shaft 41 drives the sending shaft 42 to rotate. Thus, the pencils in the receiving slots 412, 422 are orderly sent into the hustling mechanism 5, the sharpening mechanism 7, and the exit mechanism 9.

The sending mechanism 3 further includes an orientation switch 47. The orientation switch 47 is mounted to a switch board 46 and is connected to a switch pusher 48. A protrusion 382 protrudes out from the second drive gear 38, corresponding to the receiving slots 412 of the second drive shaft 41 and the receiving slots 422 of the sending shaft 42. When the pencils are sent to a determined position of the sharpening mechanism 7, the protrusion 382 pushes the switch pusher 48 to trigger the orientation switch 47. The motor 31 is stopped. The pencils are clamped by a rubber hustling wheel 53 of the hustling mechanism 5 (see FIG. 6), and align with a center of the sharpening mechanism 7. Additionally, the motor 31 starts to rotate after a determined period when the shaft 23 accomplishes to push the pencil, till the pencils are tightly in order and an anterior pencil tightly depending on the sending shaft 42. The determined period is controlled by computer program.

Referring to FIGS. 6 and 7 again, the hustling mechanism 5 includes the rubber hustling wheel 53, a stationary shaft 60 passing through a center of the rubber hustling wheel 53, a drive gear assembly 55, a gear shaft assembly 59 passing through the drive gear assembly 55, and a drive gear 58 meshing with a gear of the drive gear assembly 55 to drive the stationary shaft 60 and the hustling wheel 53. Protecting covers 52, 54 are mounted to opposite sides of the hustling wheel 53. A torsion spring 50 fits about each end of the stationary shaft 60. When pencils are sent into the hustling mechanism 5, the pencils overcome elasticity of the torsion springs 50 forcing on the stationary shaft 60 and move along a slanting surface of the protecting cover 52. Thus, the pencils are hustled into the hustling wheel 53. The drive gear assembly 55 rotates to drive the bustling wheel 53 to rotate. The pencils in the receiving slots 412 of the second drive shaft 41 and the receiving slots 422 of the sending shaft 42 slide on the hustling wheel 53. Thus, the hustling mechanism 5 automatically sends pencils to the sharpening mechanism 7 or withdraws pencils from the sharpening mechanism 7. The drive gear assembly 55 is rotated by the sharpening mechanism 7. Only when the pencils are withdrawn along a slanting surface of the protecting cover 54, tips of the pencils would not break. Thus, the pencils safely exit from the hustling mechanism 5, and at the same time, the pencils are automatically centered. The protecting covers 52, 54 prevent the hustling wheel 53 from being damaged, and reduce resistances and wallops during the pencils being hustled in or out.

A detecting switch 51 is mounted to the hustling mechanism 5. The detecting switch 51 detects whether a pencil rotates to a corresponding position of the sending shaft 42 and reaches a determined length or not, and controls the sending shaft 42 to rotate or not according to detecting results.

The sharpening mechanism 7 includes an exit orientation switch 61, sharpening orientation switch 73, and a cutter subassembly 79 located between the exit orientation switch 51 and the sharpening orientation switch 73. The exit orientation switch 61 is mounted under the hustling wheel 53 and connected to a pushing pole 62. Rubber wheels 86 are located between the cutter subassembly 79 and the exit orientation switch 61.

If the detecting switch 51 does not detect a pencil, the sending shaft 42 keeps on rotating. For example, if a pencil is short enough, such as less than 60 mm, the detecting switch 51 can not be triggered. The sending shaft 42 keeps on rotating, the pencil passes the sharpening mechanism 7 and directly enters into the exit pencil vase 92. If the detecting switch 51 detects a pencil, the sending shaft 42 is stopped. At this time, the hustling wheel 53 rotates and sends the pencil hustled in therein to the rubber wheels 86 then to the cutter subassembly 79 to be sharpened, until a sharpened tip of the pencil touches the sharpening orientation switch 73. The hustling wheel 53 rotates inversely to withdraw the pencil to the exit orientation switch 61. After the pencil that is sharpened is withdrawn to a determined position, the motor 31 drives the sending shaft 42 to rotate, and the sending shaft 42 takes the pencil from the hustling mechanism 5 and then sends it into the exit mechanism 9.

Referring to FIG. 8 again, the exit mechanism 9 includes a poking shaft 96, a cover 94, a spring 95, and several pieces of sponge 93 located at an entrance 922 of the exit pencil vase 92. A plurality of poking teeth 962 extends out from a circumference of the poking shall 96. The cover 94 compresses the spring 95 at an upper end of the poking shaft 96. The poking teeth 962 of the poking shall 96 extend into the corresponding annular guiding slots 426. The pencils move toward the entrance 922 of the exit pencil vase 92 after touching the poking teeth 962. The pencils are then damped by the sponge 93 and erectly move forward. Thus, the pencils enter into the exit pencil vase 92 through the entrance 922.

The above-mentioned movements are continuously and circularly carried on, until all the pencils are sharpened.

Referring to FIG. 9 again, the electric multi-pencil sharpener further includes a detecting mechanism 90. The detecting mechanism 90 includes two opened electrode springs 97, a spring shaft 98, and a cover 99. The electrode springs 97 are mounted to opposite ends of the spring shall 98. The cover 99 is pressed on the top end of the spring shaft 98. If a pencil is inversely placed, in other words, if a metal shell at an end of the pencil points downward, the metal shell is touched by the electrode springs 97, which will form a short circuit and give an alarm. The sending shaft 42 is driven to rotate by the motor 31 and sends the pencil without being sharpened to the exit mechanism 9, further to the exit pencil vase 92.

Figure 10:
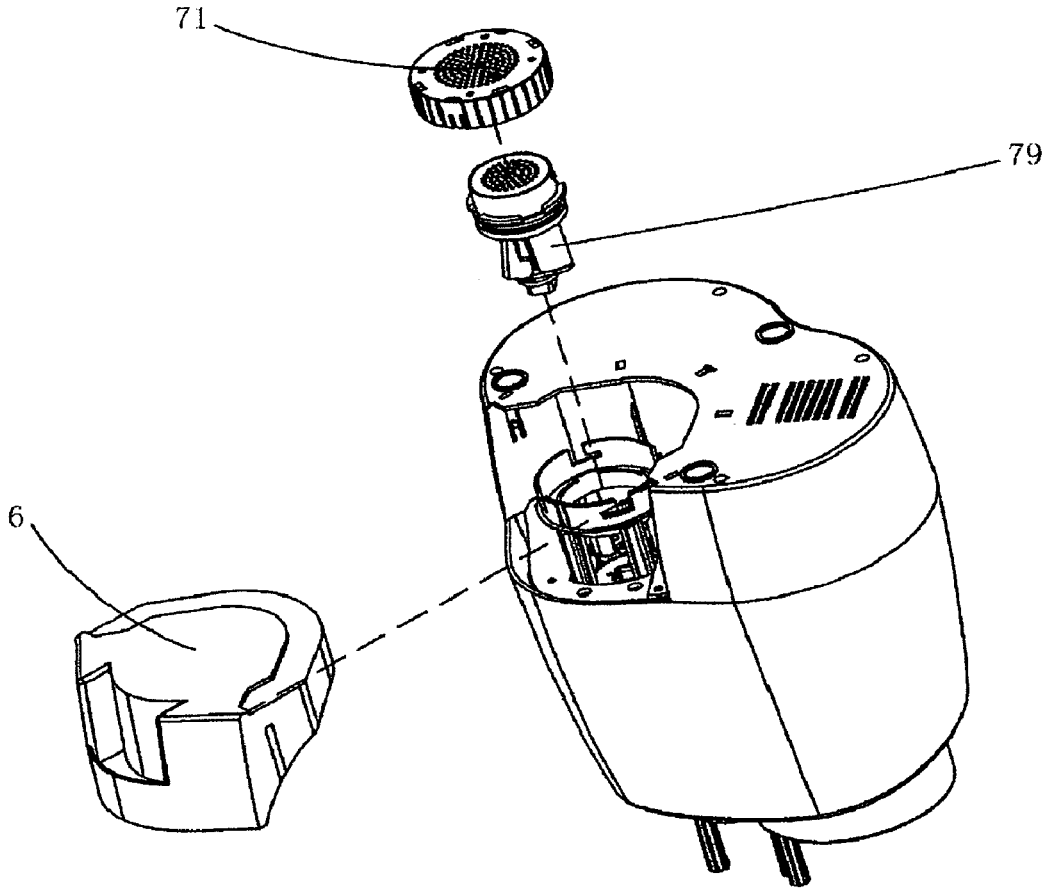
FIG. 10 is an exploded, and isometric view of the replaceable cutter subassembly of the electric multi-pencil sharpener.

Referring to FIG. 10, the electric multi-pencil sharpener still further includes a removable receptacle 6 that is provided for collecting shavings, and a rotatable cover 71 at a bottom of the sharpening mechanism 7. The rotatable cover 71 is connected to the bottom of the sharpening mechanism 7, such as pivotably mounted thereto or by clips, etc. When the cutter subassembly 79 is needed to be replaced by a new one, the receptacle 6 is drawn out. The rotatable cover 71 is turned to left, and then the cutter subassembly 79 is easily and conveniently replaced by hand. A new cutter subassembly 79 is placed down, and the rotatable cover 71 is turned to right until being fastened. Thus, the new cutter subassembly 79 is replaced.

The electric multi-pencil sharpener of this invention takes pencils from the entering pencil vase 10 and sends the pencils into the sharpening mechanism 7 to be sharpened via cooperation of the pushing mechanism 1, the sending mechanism 3 and the hustling mechanism 5. After the pencils are sharpened by the sharpening mechanism 7, the sending mechanism 3 sends the pencils into the exit mechanism 9, and finally into the exit pencil vase 92. The electric multi-pencil sharpener of this invention automatically continues to sharpen pencils, which is efficient.

It is believed that the present embodiment and its advantages will be understood from the foregoing description, and it will be apparent that various changes may be made thereto without departing from the spirit and scope of the invention or sacrificing all of its material advantages, the example hereinbefore described merely being a preferred or exemplary embodiment of the invention.

What is claimed is:

1. An electric multi-pencil sharpener, comprising:

an entering pencil vase that has a pushing mechanism therein;

a sending mechanism;

a sharpening mechanism for sharpening the pencils;

a hustling mechanism for taking the pencils into or out of the sharpening mechanism; and an exit pencil vase having an exit mechanism therein;

wherein the pushing mechanism comprises a first motor, a first reduction gear assembly, two clutch boards, a compression spring, a bearing gear, and a shaft mounted to a bearing board; the first reduction gear assembly, the bearing gear, the clutch boards, the compression spring, and the bearing board are engaged with each other to transmit motivity of the first motor to the shaft; an annular slot is defined between the entering pencil vase and the shaft for receiving the pencils; a plurality of pushing arms extend out from a circumference of the shaft, for pushing the pencils to move in the annular slot; the shaft has a cone-shaped surface at an end thereof that is located at an open end of the entering pencil vase thereof;

the sending mechanism comprises a second motor, a second reduction gear assembly meshing with the second motor, a first drive gear connected to the second reduction gear assembly, a second drive gear meshing with the first drive gear, a drive shaft connected to the second drive gear, a sending shaft, a plurality of sending wheels, a plurality of wheel shafts, and a plurality of pressing members; the drive shaft passes through a center of the sending shaft, the wheel shafts pass through centers of the corresponding sending wheels and are mounted to the sending shaft via the corresponding pressing members;

the sending mechanism is engaged with the pushing mechanism, the hustling mechanism, and the exit mechanism; the hustling mechanism is engaged with the sharpening mechanism; whereby the shaft with the pushing arms of the pushing mechanism pushes pencils to the sending shaft of said sending mechanism, said sending shaft sends pencils to the hustling mechanism or to the exit mechanism, the hustling mechanism sends pencils to sharpening mechanism and takes the sharpened pencils back to the sending shaft, then the sending shaft sends the sharpened pencils to the exit mechanism, and finally pencils enter into the exit pencil vase from the exit mechanism.

2. The electric multi-pencil sharpener as claimed in claim 1, wherein at least two axial receiving slots are defined in a circumference of the sending shaft, each for receiving a pencil, the sending wheels are mounted in the corresponding receiving slots via the pressing members.

3. The electric multi-pencil sharpener as claimed in claim 2, wherein an orientation switch is mounted to the sending mechanism, the sending mechanism is connected to a switch pusher, a protrusion according to the axial receiving slots of the sending shaft extends from the second drive gear for pushing the switch pusher to trigger the orientation switch.

4. The electric, multi-pencil sharpener, comprising:

an entering pencil vase that has a pushing mechanism therein;

a sending mechanism;

a sharpening mechanism for sharpening the pencils;

a hustling mechanism for taking the pencils into or out of the sharpening mechanism; and an exit pencil vase having an exit mechanism therein;

wherein the hustling mechanism comprises a hustling wheel, a stationary shaft passing through a center of the hustling wheel, a drive gear assembly, a gear shaft assembly passing through the drive gear assembly, and a drive gear meshing with a gear of the drive gear assembly to drive the stationary shaft and the hustling wheel to rotate, the hustling wheel positively and negatively rotates via the drive gear assembly;

the sending mechanism is engaged with the pushing mechanism, the hustling mechanism, and the exit mechanism; the hustling mechanism is engaged with the sharpening mechanism; whereby the pushing mechanism pushes pencils in said entering pencil vase to said sending mechanism, said sending mechanism sends pencils to said hustling wheel of the hustling mechanism or to the exit mechanism, the hustling wheel sends pencils to sharpening mechanism and takes the sharpened pencils back to the sending mechanism, then the sending mechanism sends the sharpened pencils to the exit mechanism, and finally pencils enter into the exit pencil vase from the exit mechanism.

5. The electric multi-pencil sharpener as claimed in claim 4, wherein the hustling mechanism further comprises two torsion springs each fits about a corresponding end of the stationary shaft, for clamping the pencils and making the pencils centering.

6. The electric multi-pencil sharpener as claimed in claim 4, wherein two covers are mounted to opposite sides of the hustling wheel.

7. The electric multi-pencil sharpener as claimed in claim 2, wherein the exit mechanism comprises a poking shaft, a cover, and a spring located between a corresponding end of the poking shaft and the cover, a plurality of poking teeth protrude from the poking shaft, a plurality of annular guiding slots are defined in the circumference of the sending shaft, for slidably receiving the corresponding poking teeth of the poking shaft.

8. The electric multi-pencil sharpener as claimed in claim 1, further comprises a detecting mechanism, wherein the detecting mechanism comprises two opened electrode springs, the electrode springs form a short circuit when the electrode springs are touched by a metal shell at an end of a pencil, to start the second motor of the sending mechanism and send the pencil that is not sharpened into the exit pencil vase via the exit mechanism.

9. The electric multi-pencil sharpener as claimed in claim 1, further comprises a detecting switch that detects whether a pencil rotates to a corresponding position of the sending shaft and reaches a determined length or not, wherein the detecting controls the sending shaft to rotate or not according to the detecting results.

10. The electric multi-pencil sharpener as claimed in claim 1, further comprises a rotatable cover at a bottom of the sharpening mechanism, for conveniently replacing a cutter subassembly of the sharpening mechanism.

* * * * *